US005853154A

United States Patent [19]

Ashley

[11] Patent Number: 5,853,154

[45] Date of Patent: Dec. 29, 1998

[54] CONTAINER TIPPER

[76] Inventor: Richard E. Ashley, 14 Orange Rd., West Milford, N.J. 07480

[21] Appl. No.: 798,494

[22] Filed: Feb. 10, 1997

Related U.S. Application Data

[63] Continuation of Ser. No. 448,885, May 24, 1995, abandoned.

[51] Int. Cl.[6] ..... A47G 23/02

[52] U.S. Cl. ..... 248/148; 248/146; 222/173

[58] Field of Search ..... 248/146, 147, 248/148, 105, 152, 346.03, 346.5, 371, 671; 222/173, 185.1, 416

[56] References Cited

U.S. PATENT DOCUMENTS

| | | | |
|---|---|---|---|
| 1,268,867 | 6/1918 | Mojonnier . | |
| 1,772,265 | 8/1930 | Porter | 248/49 |
| 1,829,353 | 10/1931 | Hogan | 248/105 |
| 2,321,836 | 6/1943 | Marzo | 222/173 |
| 2,963,167 | 12/1960 | Norman . | |
| 3,220,685 | 11/1965 | Himler . | |
| 3,430,817 | 3/1969 | Falkenberg | 22/173 |
| 3,814,293 | 6/1974 | Daves | 248/105 |
| 3,964,709 | 6/1976 | La Belle | 248/133 |
| 4,003,503 | 1/1977 | Aldridge | 222/173 |
| 4,515,334 | 5/1985 | Horne | 248/146 |
| 4,795,117 | 1/1989 | Siteman | 248/146 |
| 5,141,188 | 8/1992 | DeBlasi | 248/142 |
| 5,238,146 | 8/1993 | Thorne | 248/146 |

*Primary Examiner*—Leslie A. Braun
*Assistant Examiner*—Gwendolyn Baxter
*Attorney, Agent, or Firm*—Alfred C. Hill

[57] ABSTRACT

A device to tip a container containing a liquid to enable substantially complete emptying of the liquid from the container by a siphon comprising a bottom surface to support the device; an inclined top surface disposed at a predetermined angle with respect to the bottom surface upon which the container is supported in a substantially upright, but tipped condition; and an arrangement disposed adjacent a low point of the inclined surface to prevent the container from sliding off the inclined surface.

9 Claims, 1 Drawing Sheet

CONTAINER TIPPER

BACKGROUND OF THE INVENTION

This application is a continuation of application Ser. No. 08/448,885, filed May 24, 1995, now abandoned.

The present invention relates to containers containing a liquid, such as a bottle, and more particularly to a device for tipping such a container so as to get all of the liquid possible out of the container by means of a siphon.

It is well known that when a liquid is being siphoned from a liquid containing container that if the container is maintained in an upright position that the siphon cannot completely empty the container and as a result the liquid contents are wasted which is cost inefficient. It has been a practice in the past to employ a pencil, a match book or similar objects to tip the container into a suitable position in order to concentrate the liquid in a small area of the bottom of the container to enable the siphon to siphon off substantially completely the liquid in the container. This practice can be very dangerous particularly if the liquid is a corrosive or toxic or flammable solvent.

The use of the temporary tipping objects mentioned hereinabove and equivalents thereof result in a dangerous situation since the container in a tipped position by these devices can easily slip and spill the containers on a person observing the mixing of several solvents, or can result in destruction to property surrounding such a process employing a container containing a corrosive solvent.

The prior art discloses numerous patents that involve a tipping of a container, such as an ink well, or a nail polish bottle. Such prior art include U.S. Pat. Nos. 1,268,867; 2,963,167; 3,220,685; 3,964,709; 4,795,117 and 5,141,188 as well as Australian Patent 17,411 and British Patent 221,739. None of these prior art patents disclose a device employing an inclined surface to tip a container to enable siphoning the liquid substantially completely from a container.

SUMMARY OF THE INVENTION

An object of the present invention is to provide a device to safely tip a container containing a liquid so that a siphon can almost completely empty the liquid from the container.

Another object of the present invention is to provide a device that tips a transparent bottle containing a liquid to enable a substantially complete emptying of the liquid from the bottle by a siphon in a safe manner and to enable viewing the liquid level in the bottle.

Still another object of the present invention is to provide a device to safely tip a container containing a liquid to enable a substantially complete emptying of the liquid from the container by a siphon and to prevent accidental spilling of the liquid from the container.

A feature of the present invention is the provision of a device to tip a container containing a liquid to enable substantially complete emptying of the liquid from the container by a siphon comprising a bottom surface to support the device; and an inclined top surface disposed at a predetermined angle with respect to the bottom surface upon which the container is supported in a tipped condition; and a means disposed adjacent a low point of the inclined surface to prevent the container from sliding off the inclined surface and spilling its contents.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENT

Figure 1:
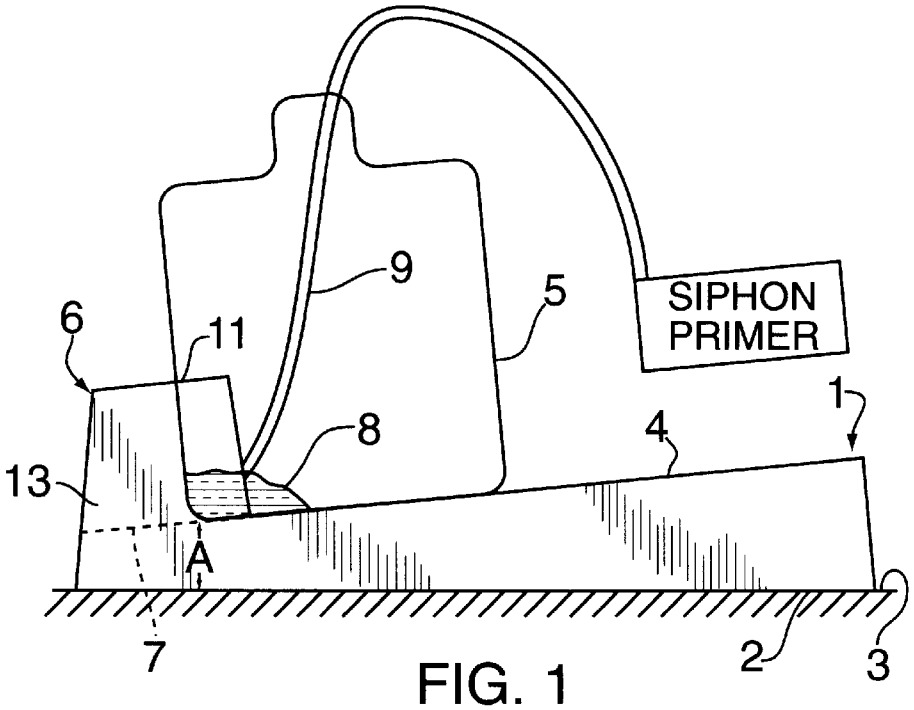
FIG. 1 is a side view of the container tipping device in accordance with the principles of the present invention.
Figure 2:
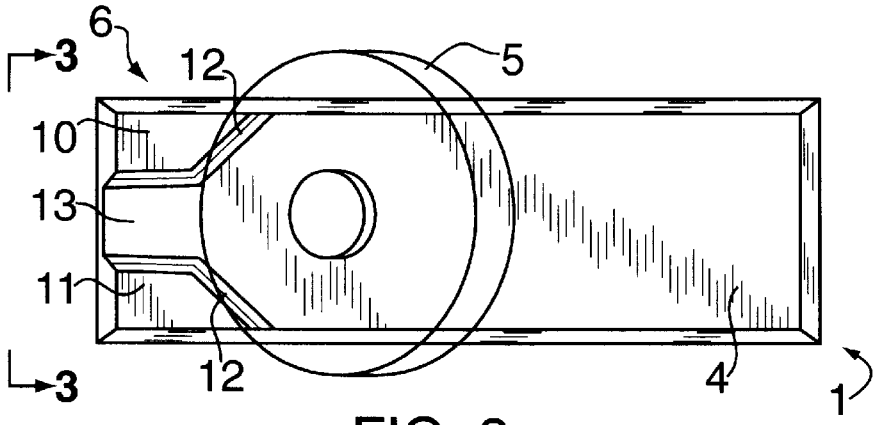
FIG. 2 is a top plan view of the container tipping device of FIG. 1 showing its employment with a round or circular container in accordance with the principles of the present invention.
Figure 3:
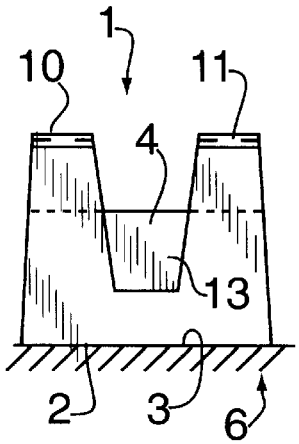
FIG. 3 is an end view of the device of FIG. 1 taken along line 3—3 of FIG. 2.

Referring to FIGS. 1–3, the container tipping device 1 of the present invention includes a bottom surface 2 to support the container tipping device 1 on a counter 3, or another support member, such as a table or lab bench. Device 1 further includes an inclined top surface 4 disposed at a predetermined angle A with respect to bottom surface 2 upon which the container in the form of a transparent bottle 5 is supported in a tipped condition. Device 1 also includes a means 6 disposed adjacent a low point 7 of inclined surface 4 to prevent the bottle 5 from sliding off the inclined surface 4 and spilling the contents thereof. The means 6 may have a shape as illustrated in FIG. 2 to cradle the bottle 5 to prevent bottle 5 from sliding off the inclined surface either down the slope of surface 4 or off the sides of surface 4.

Although it is described herein that the container is a transparent bottle 5, it is to be clearly understood that the container can be any container, even an opaque container that needs to be tipped so that the fluid 8 is caused to gravitate to an area in the container such that siphon 9 can almost completely empty bottle 5.

Preferably member 6 is provided by a pair of members 10 and 11 disposed substantially perpendicular to inclined surface 4 having a surface 12 shaped to cradle the bottle 5 to prevent bottle 5 from slipping off surface 4. Members 10 and 11 are spaced with respect to each other to form a window 13 therebetween so that the contents of the bottle 5 can be viewed by an observer.

It has been determined that the predetermined angle A is a selected angle in the range of 10° to 25°. Preferably the selected angle is 15°. These angles provide the necessary tipping of the container, such as bottle 5, to enable the siphon 9 to empty the bottle 5 almost completely and yet provides a safe tipping of the bottle 5 so that bottle 5 will not tip due to weight of the bottle, its contents and the pull of the siphon on bottle 5. This prevents injury to people and property surrounding the area of use by the spilling of the liquid in bottle 5, such as a toxic or flammable or corrosive solvent, should angle A be too great.

Figure 4:
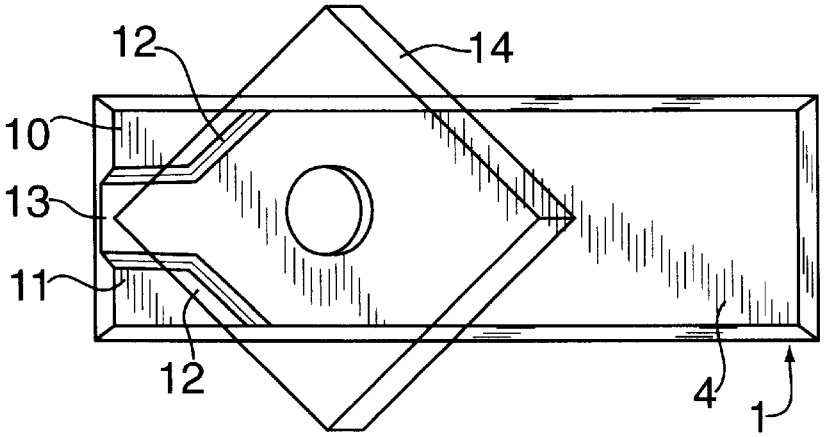
FIG. 4 is a top plan view of the device of FIG. 1 similar to that shown in FIG. 2 but employed with a square container.

FIG. 2 shows that the bottle 5 which is made of transparent material, such as glass or a transparent plastic, is circular in nature. The device 1 of the present invention can be used with other shaped bottles, such as the square bottle 14 shown in FIG. 4. The container, such as bottle 5, can have any shape as long as the surfaces 12 can cradle the container and prevent the slipping of the container from the inclined surface 4.

While I have described above the principles of my invention in connection with specific apparatus, it is to be clearly understood that this description is made only by way of example and not as a limitation to the scope of my invention as set forth in the objects thereof and in the accompanying claims.

I claim:

1. A device to tip a container containing a liquid to enable substantially complete emptying of said liquid from said container by a siphon comprising:

a container to be tipped having a top, a bottom and a sidewall extending between said top and said bottom, said container containing a liquid to be substantially completely emptied by a siphon inserted into an opening in said top of said container;

a bottom surface to support said device;

an inclined top surface disposed at a predetermined angle with respect to said bottom surface upon which all of said bottom of said container is supported to support said container in a substantially upright, but tipped condition; and at least one member disposed adjacent a low point of and substantially perpendicular to said inclined top surface engaging and cradling said sidewall of said container to prevent said container from sliding off said inclined top surface.

2. The device according to claim 1, wherein said predetermined angle is a selected angle in a range of 10° to 25°.

3. The device according to claim 2, wherein said selected angle is 15°.

4. A device to tip a container containing a liquid to enable substantially complete emptying of said liquid from said container by a siphon comprising:

a container to be tipped having a top, a bottom and a sidewall extending between said top and said bottom, said container containing a liquid to be substantially completely emptied by a siphon inserted into an opening in said top of said container;

a bottom surface to support said device;

an inclined top surface disposed at a predetermined angle with respect to said bottom surface upon which all of said bottom of said container is supported to support said container in a substantially upright, but tipped condition; and a pair of members disposed adjacent a low point of and substantially perpendicular to said inclined top surface and shaped to engage and to cradle said sidewall of said container to prevent said container from sliding off said inclined top surface.

5. The device according to claim 4, wherein said predetermined angle is a selected angle in a range of 10° to 25°.

6. The device according to claim 4, wherein said selected angle is 15°.

7. The device according to claim 4, wherein said container is a bottle made of transparent material, and said pair of members are spaced with respect to each other to enable viewing said liquid in said bottle.

8. The device according to claim 7, wherein said predetermined angle is a selected angle in a range of 10° to 25°.

9. The device according to claim 8, wherein said selected angle is 15°.

* * * * *